US008550447B1

(12) United States Patent
Lee

(10) Patent No.: US 8,550,447 B1
(45) Date of Patent: Oct. 8, 2013

(54) AUTOMATIC DOCUMENT FEEDER

(71) Applicant: Primax Electronics Ltd., Taipei (TW)

(72) Inventor: Chun-Yu Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/663,689

(22) Filed: Oct. 30, 2012

(30) Foreign Application Priority Data

Aug. 31, 2012 (TW) ..... 101131718 A

(51) Int. Cl.
*B65H 5/22* (2006.01)

(52) U.S. Cl.
USPC ..... 271/3.14; 271/145; 399/367; 399/369

(58) Field of Classification Search
USPC ..... 271/3.14, 145; 399/367, 369
See application file for complete search history.

(56) References Cited

U.S. PATENT DOCUMENTS 5,743,522 A * 4/1998 Rubscha et al. ..... 271/265.02
7,059,597 B2 * 6/2006 Shirakura et al. ..... 271/171
7,099,619 B2 * 8/2006 Choi ..... 399/367
7,702,276 B2 * 4/2010 Kawashima ..... 399/367
2004/0056413 A1 * 3/2004 Shirakura et al. ..... 271/145
2004/0170456 A1 * 9/2004 Choi ..... 399/367
2007/0127962 A1 * 6/2007 Fukumura ..... 399/367
2008/0019747 A1 * 1/2008 Lee ..... 399/367
2010/0040398 A1 * 2/2010 Shin ..... 399/367

* cited by examiner

*Primary Examiner* — David H Bollinger
(74) *Attorney, Agent, or Firm* — Tracy M. Heims; Apex Juris, pllc

(57) ABSTRACT

An automatic document feeder includes a document input tray, a document discharge tray, a pushing member, and an elastic element. The document discharge tray is disposed under the document input tray. The pushing member is disposed on the document input tray. By pushing the pushing member, the pushing member is swung relative to the document input tray. The elastic element is contacted with the pushing member and the document input tray. The elastic element provides an elastic force to the pushing member. When the pushing member is not pushed, the pushing member is returned to an original position in response to the elastic force. By pushing the pushing member to allow the pushing member to be swung relative to the document input tray, the document discharge tray is exposed through the document input tray. Consequently, the paper sheet can be easily removed from the document discharge tray.

14 Claims, 9 Drawing Sheets

AUTOMATIC DOCUMENT FEEDER

FIELD OF THE INVENTION

The present invention relates to an automatic document feeder, and more particularly to an automatic document feeder with a document input tray and a document discharge tray, in which the document discharge tray is disposed under the document input tray.

BACKGROUND OF THE INVENTION

With increasing development of scientific technologies, the method for storing documents is changed from the filing of paper documents to the storage of the electronic files of the documents. Generally, a scanning apparatus is a device for scanning the contents of paper documents into electronic files, which are then spread, processed or stored.

In the early stage, the scanning apparatus can only scan one side of the document. For scanning both sides of the document, after one side of the document has been scanned, the document should be manually turned over so as to scan the other side of the document. However, the process of manually turning over the document is troublesome. For solving the drawbacks, an automatic document feeder is usually integrated into a flatbed scanning apparatus. Consequently, a stack of documents can be successively transported by the automatic document feeder and the duplex scanning operation can be performed by the flatbed scanning apparatus without the need of manually turning over the documents. The automatic document feeder is not only used with the scanning module of the scanning apparatus. Nevertheless, the automatic document feeder may be used with a printing module of a printing apparatus.

Conventionally, the automatic document feeder and the flatbed scanning apparatus are integrated as a sheet-feeding type scanning apparatus. Hereinafter, the structure of a conventional automatic document feeder will be illustrated with reference to FIG. 1. FIG. 1 is a schematic side view illustrating the automatic document feeder and the flatbed scanning apparatus of a conventional sheet-feeding type scanning apparatus. As shown in FIG. 1, the conventional automatic document feeder 1 comprises a document pick-up module 10, an upper cover 11, a separation pad 12, a conveying channel 13, a document input tray 14, a document discharge tray 15, plural conveying roller assemblies 16, and a document discharge roller assembly 17. The document input tray 14 is used for placing plural documents S thereon. The document discharge tray 15 is disposed under the document input tray 14. After the plural documents S are scanned, the scanned documents S are placed on the document discharge tray 15. The document pick-up module 10 is disposed under the upper cover 11 for transporting the plural documents S from the document input tray 14 into the conveying channel 13. The document pick-up module 10 comprises a pick-up roller 101 and a separation roller 102. The pick-up roller 101 is used for contacting the plural documents S, thereby transporting the plural documents S. The separation roller 102 is used for separating the uppermost document S from the underlying documents S, so that only a single document S is fed into the conveying channel 13 at each time. The separation pad 12 is disposed under the separation roller 102 for providing a friction force to the document S that is in contact with the separation pad 12, thereby facilitating the separation roller 102 to transport a single document S into the conveying channel 13.

The plural conveying roller assemblies 16 are disposed in the conveying channel 13 for moving the plural documents S along the conveying channel 13. The document discharge roller assembly 17 is located beside the document discharge tray 15 for ejecting the plural documents S to the document discharge tray 15. The flatbed scanning apparatus 2 is disposed under the automatic document feeder 1. The flatbed scanning apparatus 2 comprises a scanning module 20. The conveying channel 13 goes through a region over the scanning module 20. Consequently, when the document S is transported across the region over the scanning module 20, the document S is scanned by the scanning module 20.

Hereinafter, the operations of the automatic document feeder 1 will be illustrated with reference to FIG. 1. When the conventional automatic document feeder 1 is operated in a normal working mode, the document pick-up module 10 is swung downwardly to be distant from the upper cover 11 with the separation roller 102 serving as a fulcrum. Consequently, the pick-up roller 101 of the document pick-up module 10 is contacted with the plural documents S on the document input tray 14, thereby transporting the plural documents S. During the process of transporting the plural documents S by the pick-up roller 101, the uppermost document S of the plural documents S is contacted with the separation roller 102, and the lowermost document S of the plural documents S is contacted with the separation pad 12. In response to the friction force provided by the separation pad 12, the uppermost document S is separated from the underlying documents and fed into the conveying channel 13.

Next, the document S is transported by the plural conveying roller assemblies 16, so that the document S is moved along the conveying channel 13. When the document S is moved across the region over the scanning module 20, the document S is scanned by the scanning module 20, so that a scanned image of the document S is acquired. Afterwards, the scanned document S is transported by the document discharge roller assembly 17 to be ejected to the document discharge tray 15. Under this circumstance, the scanning operation on the uppermost document S has been completed. The processes of scanning the remaining documents S are similar to the above process, and are not redundantly described herein. After the plural documents S are scanned, the plural documents S may be removed from the document discharge tray 15.

In a case that the user wants to remove the plural documents S from the document discharge tray 15, some drawbacks may occur. For example, since the document discharge tray 15 is disposed under the document input tray 14, the document input tray 14 becomes hindrance from taking out the plural documents S. That is, the user's hand fails to be directly put into the region under the document input tray 14 to be contacted with the plural documents S. For solving the above drawbacks, the document input tray 14 should be uplifted by one hand of the user. Consequently, the document input tray 14 is moved upwardly in a specified direction C, and the plural documents S on the document discharge tray 15 are exposed (see FIG. 2). Then, the plural documents S are removed from the document discharge tray 15 by the other hand of the user. Then, the document input tray 14 is moved downwardly, so that the document input tray 14 is returned to the original position. In other words, the process of removing the plural documents S is not user-friendly.

Therefore, there is a need of providing an automatic document feeder for easily removing the documents from the document discharge tray.

SUMMARY OF THE INVENTION

The present invention provides an automatic document feeder for easily removing the documents from the document discharge tray.

In accordance with an aspect of the present invention, there is provided an automatic document feeder for feeding a paper sheet to a scanning region of a scanning module or a printing region of a printing module. The automatic document feeder includes a casing, a document input tray, a document discharge tray, a pushing member, and an elastic element. The document input tray is connected with the casing for placing the paper sheet thereon. The document discharge tray is disposed on the casing and located under the document input tray. After the paper sheet is transferred through the scanning region or the printing region, the paper sheet is placed on the document discharge tray. The pushing member is disposed on the document input tray and located at an end of the document input tray. By pushing the pushing member to allow the pushing member to be swung relative to the document input tray along a trajectory parallel with a top surface of the document input tray, the paper sheet on the document discharge tray is exposed through the document input tray. The elastic element has two terminals respectively contacted with the document input tray and the pushing member for providing an elastic force to the pushing member. When the pushing member is not pushed, the pushing member is returned to an original position in response to the elastic force.

In an embodiment, the pushing member includes a base plate, a contacting plate, a stopping structure, and a fixing structure. The contacting plate is extended from the base plate and perpendicular to the base plate. As the contacting plate is pushed, the base plate is correspondingly swung relative to the document input tray along the trajectory parallel with the top surface of the document input tray. The stopping structure is extended from the contacting plate and perpendicular to the base plate. When the document input tray is contacted with the stopping structure, the base plate fails to be swung. The fixing structure is extended from the contacting plate and engaged with a lower edge of the document input tray.

In an embodiment, a top surface of the base plate is parallel with the top surface of the document input tray, and an altitude of the top surface of the base plate is higher than an altitude of the top surface of the document input tray. As the contacting plate is pushed and the base plate is swung relative to the document input tray along the trajectory parallel with the top surface of the document input tray, the base plate is swung to a position over the top surface of the document input tray, and the fixing structure is moved along the lower edge of the document input tray.

In an embodiment, the base plate includes a first connecting part, which is extended from the base plate and perpendicular to the base plate. The first connecting part is connected with the document input tray, and the elastic element is sheathed around the first connecting part and fixed on the first connecting part. As the contacting plate is pushed and the base plate is swung relative to the document input tray, the elastic element is compressed by the contacting plate and the base plate is swung from a first position along the trajectory parallel with the top surface of the document input tray. When the base plate is swung to a second position, the stopping structure is contacted with the document input tray, so that the base plate is no longer swung. When the contacting plate is not pushed, the base plate is swung from the second position and returned to the first position in response to the elastic force provided by the elastic element.

In an embodiment, the document input tray includes a second connecting part. After the second connecting part is connected with the first connecting part, the first connecting part and the second connecting part are combined together.

In an embodiment, the first connecting part is a protrusion structure, and the second connecting part is a perforation.

In an embodiment, the second connecting part is extended from the document input tray and perpendicular to the top surface of the document input tray. Moreover, the first connecting part is a sleeve, and the second connecting part is a protrusion structure.

In an embodiment, the second connecting part is extended from the document input tray and perpendicular to the top surface of the document input tray. Moreover, the first connecting part is a protrusion structure, and the second connecting part is a sleeve.

In an embodiment, the document input tray includes an extension plate, a notch, and a connecting plate. The extension plate is extended from the document input tray. The notch is located at the end of the document input tray. The connecting plate is extended from a position of the extension plate near the end of the document input tray and extended toward the notch. The connecting plate is disposed under the pushing member, and the pushing member is fixed on the connecting plate. As the pushing member is pushed, the pushing member is swung from the notch along the trajectory parallel with the top surface of the document input tray.

In an embodiment, the connecting plate includes a second connecting part, which is extended from the connecting plate and perpendicular to the connecting plate. The second connecting part is connected with the pushing member, so that the pushing member is disposed on the document input tray. The elastic element is sheathed around the second connecting part. As the pushing member is pushed and the pushing member is swung relative to the connecting plate of the document input tray, the elastic element is compressed by the pushing member and the pushing member is swung from a first position to a second position along the trajectory parallel with the top surface of the document input tray. When the pushing member is not pushed, the pushing member is swung from the second position and returned to the first position in response to the elastic force provided by the elastic element.

In an embodiment, the pushing member includes a first connecting part. After the second connecting part is connected with the first connecting part, the first connecting part and the second connecting part are combined together.

In an embodiment, the first connecting part is a perforation, and the second connecting part is a protrusion structure.

In an embodiment, the first connecting part is extended from the pushing member and perpendicular to the top surface of the pushing member. Moreover, the first connecting part is a sleeve, and the second connecting part is a protrusion structure.

In an embodiment, the first connecting part is extended from the pushing member and perpendicular to a top surface of the pushing member. Moreover, the first connecting part is a protrusion structure, and the second connecting part is a sleeve.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
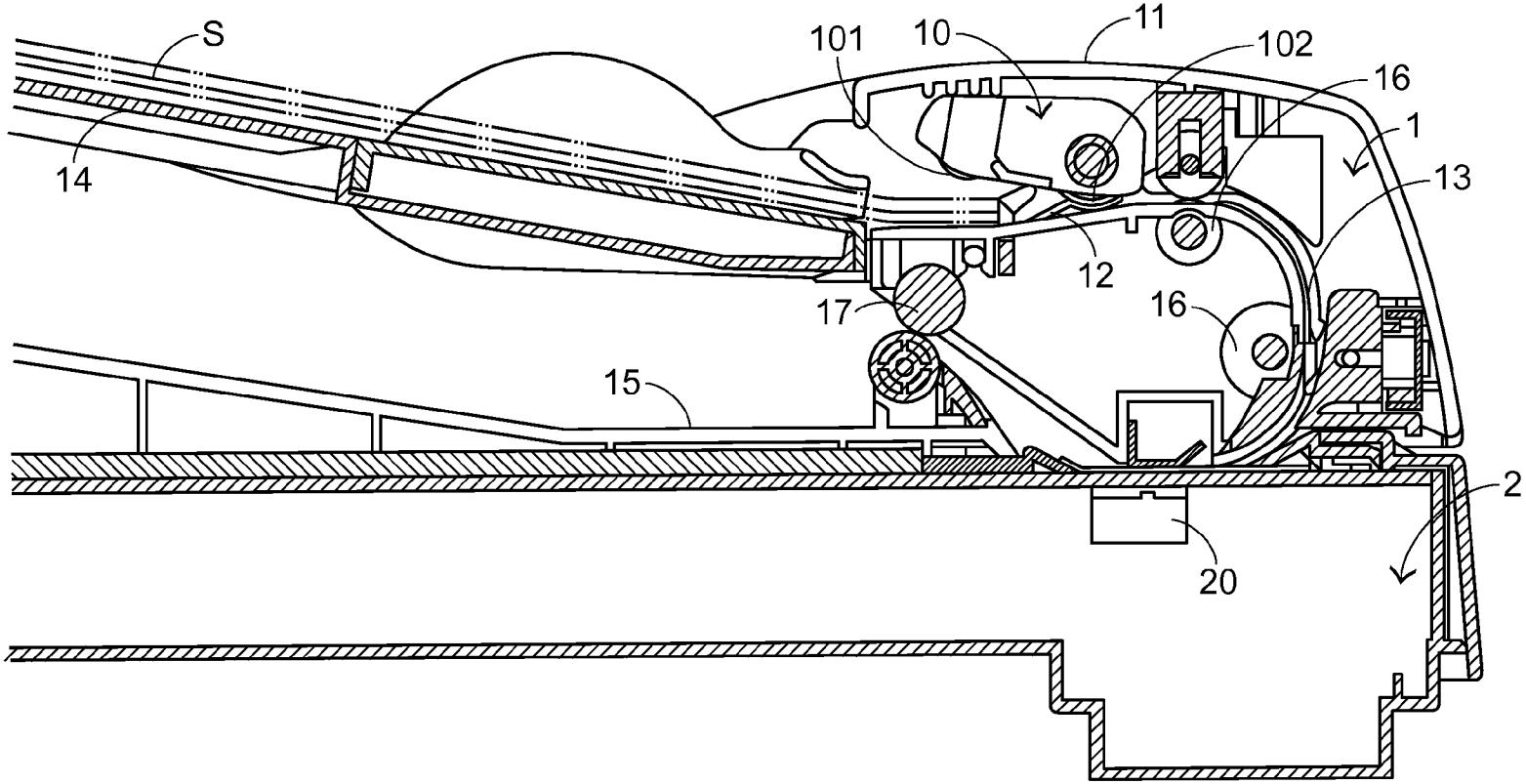
FIG.1 PRIOR ART
FIG. 1 is a schematic side view illustrating the automatic document feeder and the flatbed scanning apparatus of a conventional sheet-feeding type scanning apparatus.
Figure 2:
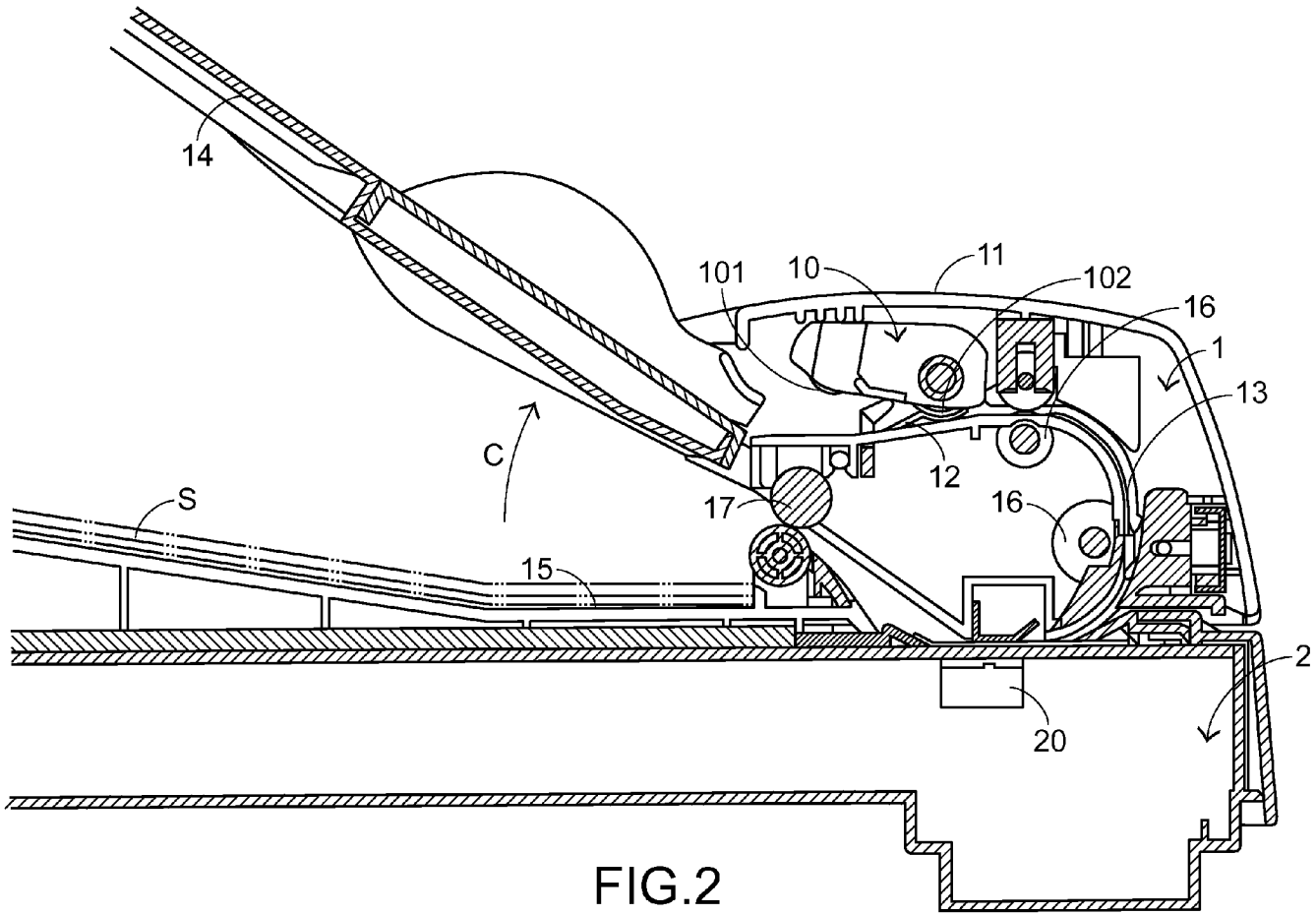
FIG.2 PRIOR ART
FIG. 2 is a schematic side view illustrating the automatic document feeder of FIG. 1, in which the document input tray is uplifted.
Figure 3:
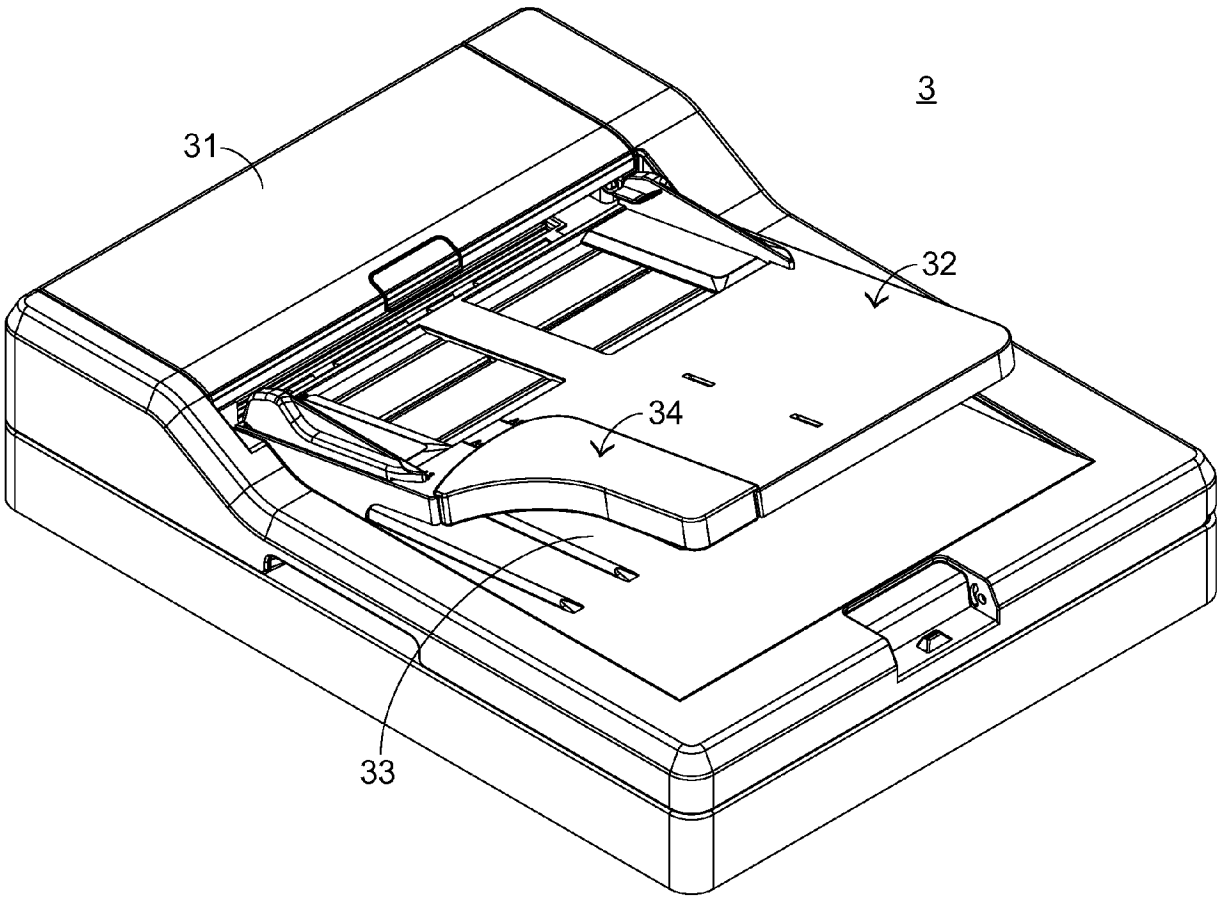
FIG. 3 is a schematic perspective view illustrating an automatic document feeder according to an embodiment of the present invention.

For eliminating the drawbacks from the prior art, the present invention provides an improved automatic document feeder. FIG. 3 is a schematic perspective view illustrating an automatic document feeder according to an embodiment of the present invention. The automatic document feeder 3 is used for feeding a paper sheet to a scanning region of a scanning module or a printing region of a printing module. For clarification and brevity, only the automatic document feeder 3 is shown in FIG. 3, but the scanning module or the printing module for use with the automatic document feeder is not shown. Moreover, the automatic document feeder 3 and the scanning module may be integrated as a sheet-feeding type scanning apparatus. Alternatively, the automatic document feeder 3 and the printing module may be integrated as a sheet-feeding type printing apparatus. The automatic document feeder 3 comprises a casing 31, a document input tray 32, a document discharge tray 33, a pushing member 34, and an elastic element 35 (see FIG. 4). The other components of the automatic document feeder 3 are similar to those of the conventional automatic document feeder 1, and are not redundantly described herein. The document input tray 32 is connected with the casing 31 for placing plural paper sheets (or documents) thereon. The document discharge tray 33 is disposed on the casing 31, and located under the document input tray 32. After the paper sheet is transferred through the scanning region or the printing region, the paper sheet is placed on the document discharge tray 33. The pushing member 34 is disposed on the document input tray 32, and located at an end 321 of the document input tray 32.

As shown in FIG. 3, the document input tray 32 and the pushing member 34 are disposed over the document discharge tray 33, so that the document discharge tray 33 is sheltered by the document input tray 32 and the pushing member 34. Under this circumstance, it is difficult to remove the paper sheets from the document discharge tray 33. Moreover, by pushing the pushing member 34, the pushing member 34 may be swung relative to the document input tray 32 along a trajectory parallel with a top surface 322 (see FIG. 4) of the document input tray 32. Consequently, the paper sheets on the document discharge tray 33 are exposed through the document input tray 32. Under this circumstance, the paper sheets on the document discharge tray 33 can be easily removed by the user.

Figure 4:
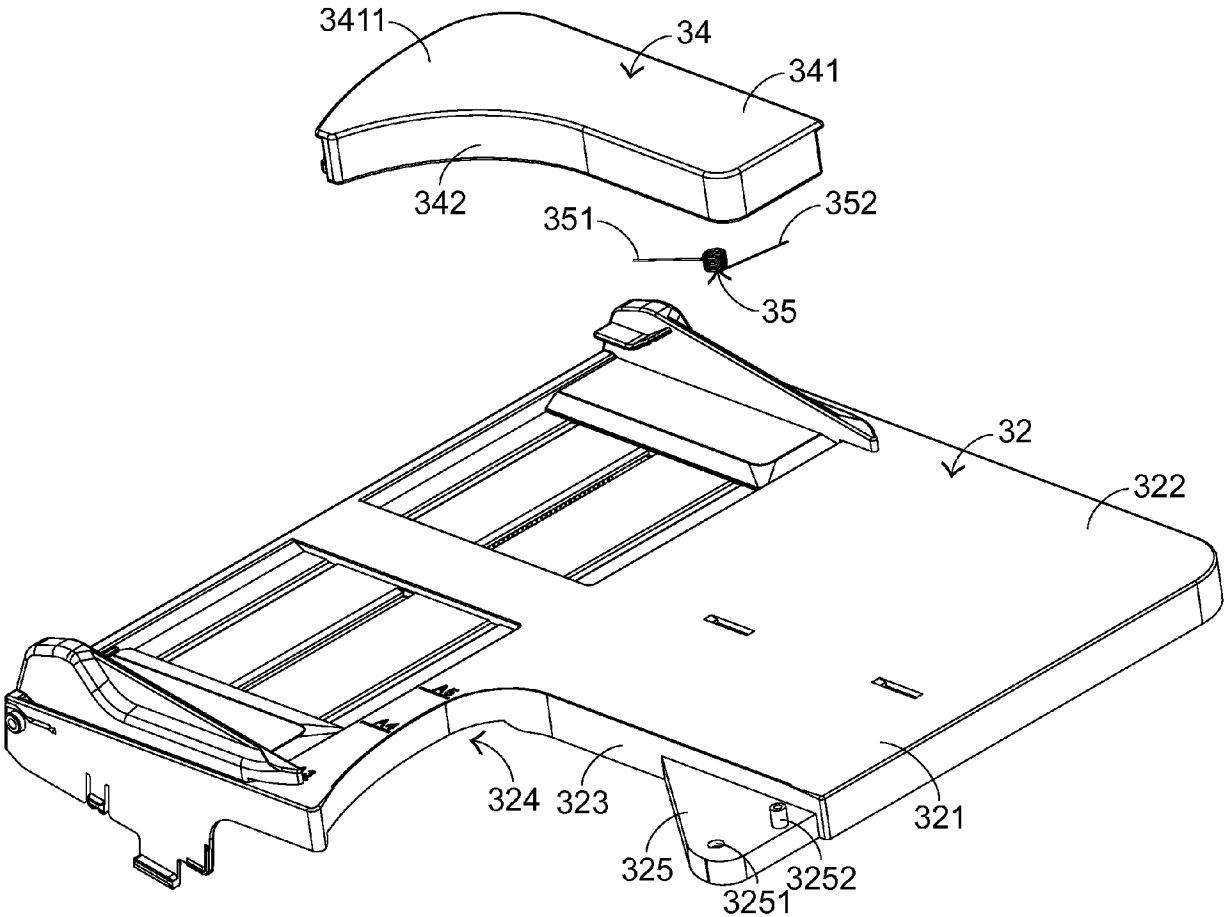
FIG. 4 is a schematic partial exploded view illustrating the document input tray and the pushing member of the automatic document feeder according to the embodiment of the present invention.

FIG. 4 is a schematic partial exploded view illustrating the document input tray and the pushing member of the automatic document feeder according to the embodiment of the present invention. In FIG. 4, the document input tray 32, the pushing member 34 and the elastic element 35 are shown. The document input tray 32 comprises an extension plate 323, a notch 324, and a connecting plate 325. The extension plate 323 is extended from the document input tray 32 in a direction toward the document discharge tray 33. That is, the extension plate 323 is extended downwardly toward the document discharge tray 33. The notch 324 is located at the end 321 of the document input tray 32. The connecting plate 325 is extended from a position of the extension plate 323 near the end 321 of the document input tray 32 and extended toward the notch 324. Moreover, the connecting plate 325 comprises a second connecting part 3251. The second connecting part 3251 is configured to be connected with the pushing member 34. In this embodiment, the extension plate 323 and the connecting plate 325 are integrally formed with the document input tray 32. In addition, the second connecting part 3251 is a perforation.

Figure 5:
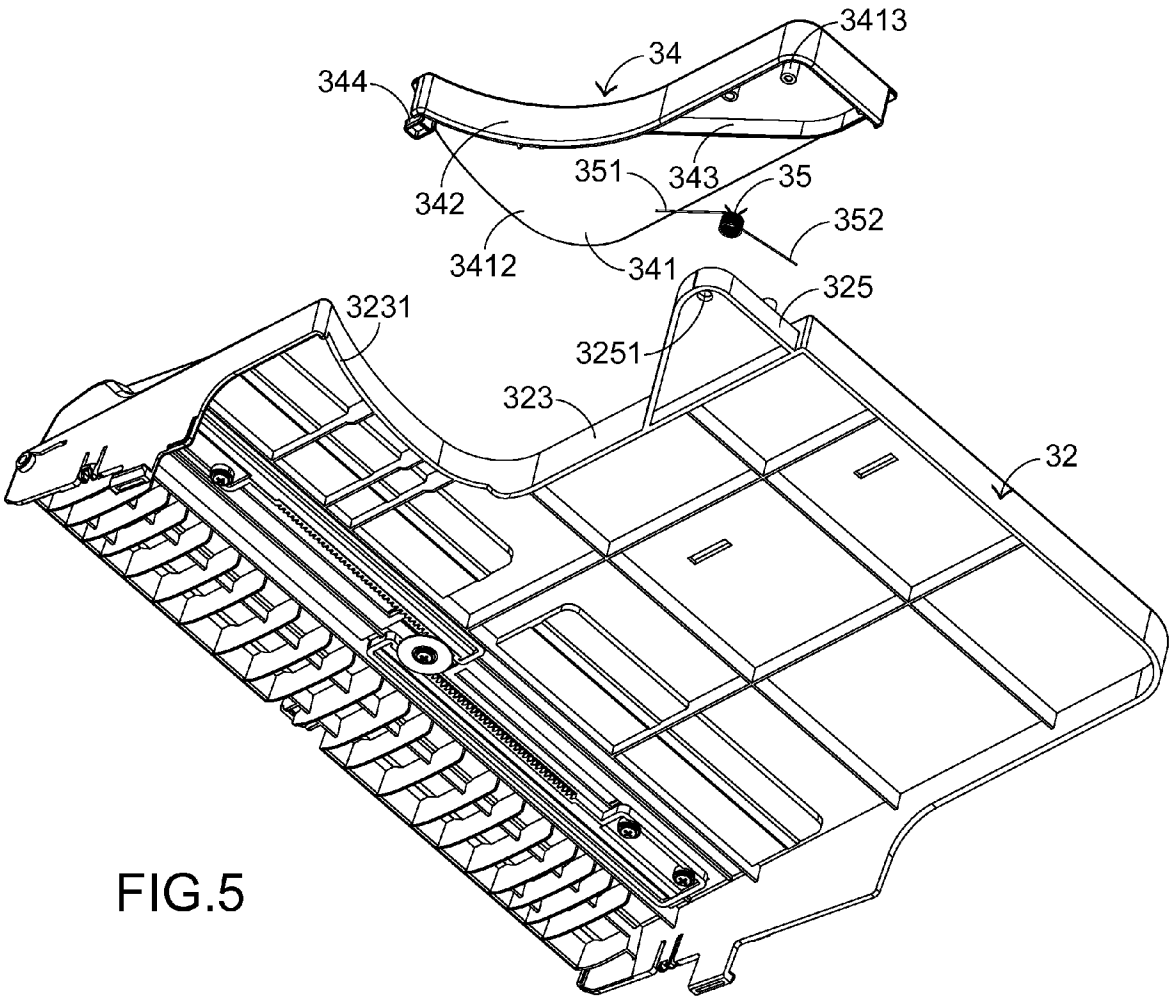
FIG. 5 is a schematic partial exploded view illustrating the document input tray and the pushing member of the automatic document feeder according to the embodiment of the present invention and taken along another viewpoint.

FIG. 5 is a schematic partial exploded view illustrating the document input tray and the pushing member of the automatic document feeder according to the embodiment of the present invention and taken along another viewpoint. As shown in FIG. 5, the pushing member 34 comprises a base plate 341, a contacting plate 342, a stopping structure 343, and a fixing structure 344. The base plate 341 comprises a first connecting part 3413. The first connecting part 3413 is extended from a bottom surface 3412 of the base plate 341 and perpendicular to the base plate 341. The first connecting part 3413 is connected with the second connecting part 3251 of the document input tray 32. In addition, the elastic element 35 is sheathed around the first connecting part 3413, so that the elastic element 35 is fixed on the first connecting part 3413. The contacting plate 342 is extended from the base plate 341 and perpendicular to the base plate 341. As the contacting plate 342 is pushed, the base plate 341 is correspondingly swung relative to the document input tray 32 along the trajectory parallel with the top surface 322 of the document input tray 32. That is, the base plate 341 is swung in the direction distant from the notch 324. The stopping structure 343 is extended from the contacting plate 342 and perpendicular to the base plate 341. When the extension plate 323 of the document input tray 32 is contacted with the stopping structure 343, the base plate 341 is no longer swung. The fixing structure 344 is extended from the contacting plate 342. In addition, the fixing structure 344 is engaged with a lower edge 3231 of the extension plate 323. In this embodiment, the first connecting part 3413 is a protrusion structure. Moreover, the first connecting part 3413 is integrally formed with the base plate 341. Moreover, the base plate 341, the contacting plate 342, the stopping structure 343 and the fixing structure 344 are all integrally formed with the pushing member 34.

Figure 6:
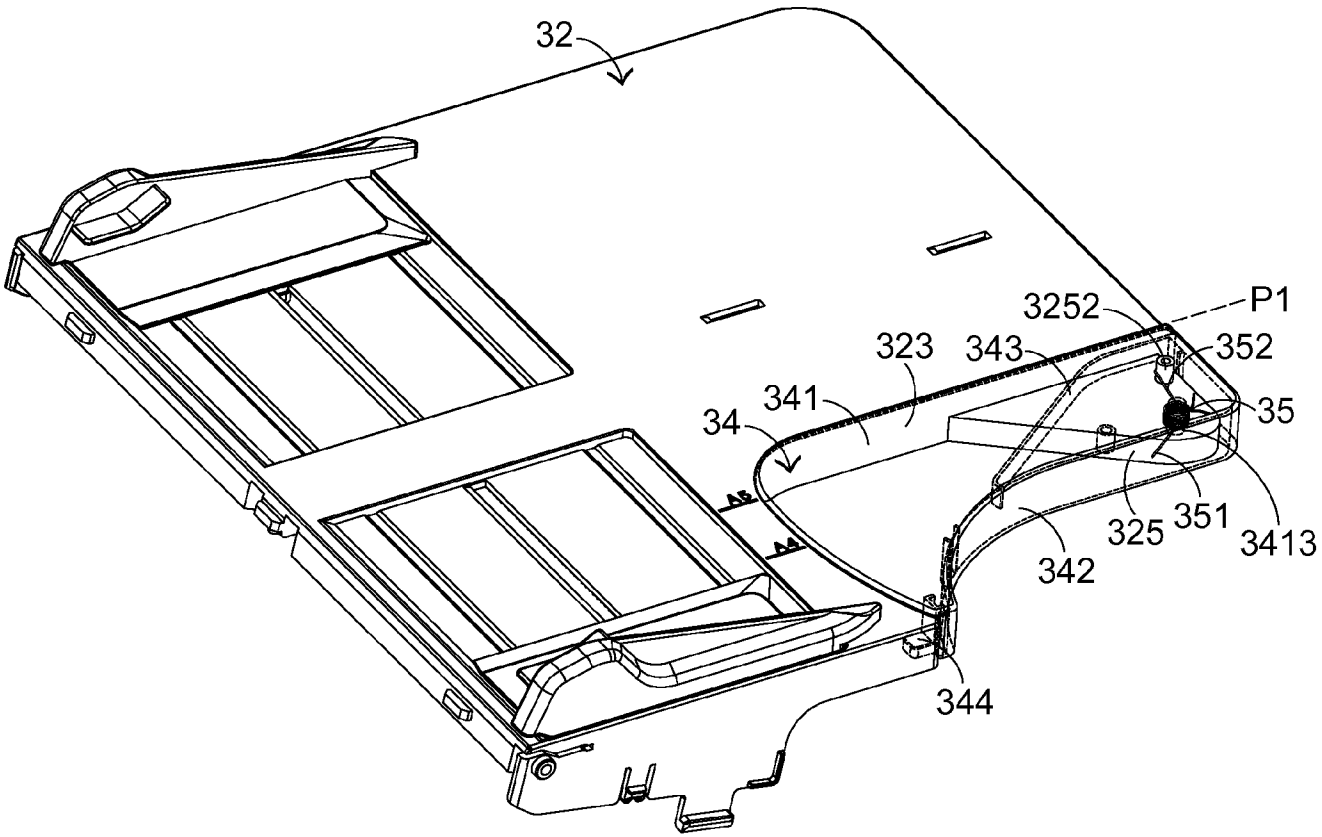
FIG. 6 is a schematic perspective view illustrating an assembly of the document input tray and the pushing member of the automatic document feeder according to the embodiment of the present invention.
Figure 7:
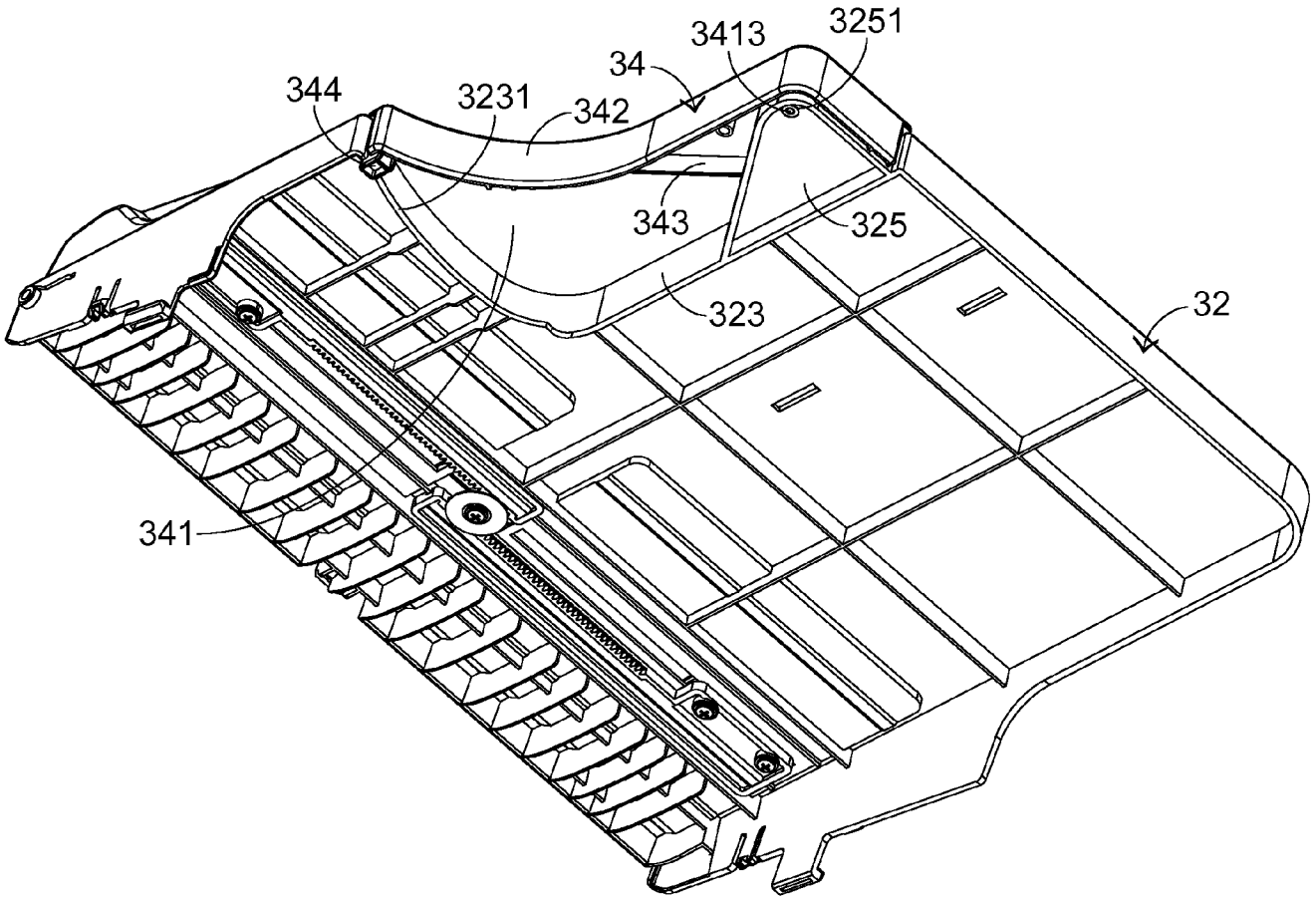
FIG. 7 is a schematic perspective view illustrating an assembly of the document input tray and the pushing member of the automatic document feeder of FIG. 6 and taken along another viewpoint.

FIG. 6 is a schematic perspective view illustrating an assembly of the document input tray and the pushing member of the automatic document feeder according to the embodiment of the present invention. FIG. 7 is a schematic perspective view illustrating an assembly of the document input tray and the pushing member of the automatic document feeder of FIG. 6 and taken along another viewpoint. Please refer to FIGS. 6 and 7. For clearly illustrating the relationships between the document input tray 32, the pushing member 34 and the elastic element 35, the pushing member 34 as shown in FIG. 6 is denoted by dotted lines. The pushing member 34 is disposed on the document input tray 32 through the first connecting part 3413 and the fixing structure 344. After the first connecting part 3413 is penetrated through the second connecting part 3251, the first connecting part 3413 and the second connecting part 3251 are combined together. Consequently, the pushing member 34 is fixed on the document input tray 32, and the pushing member 34 may be swung along the trajectory parallel with the top surface 322 of the document input tray 32. On the other hand, since the fixing structure 344 is engaged with the lower edge 3231 of the extension plate 323, the connecting relationship between the pushing member 34 and the document input tray 32 is enhanced. When the pushing member 34 is disposed on the document input tray 32, the connecting plate 325 is disposed under the base plate 341 of the pushing member 34, and a top surface 3411 of the base plate 341 is parallel with the top surface 322 of the document input tray 32. Moreover, the altitude of the top surface 3411 of the base plate 341 is higher than the altitude of the top surface 322 of the document input tray 32. In the situation as shown in FIGS. 6 and 7, the stopping structure 343 is not contacted with the extension plate 323 of the document input tray 32.

The connecting plate 325 of the document input tray 32 further comprises a contacting post 3252. The contacting post 3252 is extended from the connecting plate 325 and perpendicular to the connecting plate 325. The elastic element 35 is fixed on the first connecting part 3413 of the base plate 341. A first terminal 351 of the elastic element 35 is contacted with an inner surface of the contacting plate 342 of the pushing member 34. A second terminal 352 of the elastic element 35 is contacted with the contacting post 3252. Due to the above connecting relationships, the elastic element 35 provides an elastic force to the contacting plate 342. Consequently, when the pushing member 34 is not pushed, the pushing member 34 is returned to an original position in response to the elastic force. That is, when the pushing member 34 is not pushed, the pushing member 34 is maintained at a first position P1. In this embodiment, the contacting post 3252 is integrally formed with the connecting plate 325. Moreover, the elastic element 35 is a torsion spring. In this embodiment, the first terminal 351 of the elastic element 35 is contacted with the inner surface of the contacting plate 342 of the pushing member 34. Alternatively, in some other embodiments, the first terminal of the elastic element may be contacted with an additional protrusion structure (not shown) of the base plate, wherein the additional protrusion structure is extended from and perpendicular to the base plate of the pushing member.

Figure 8:
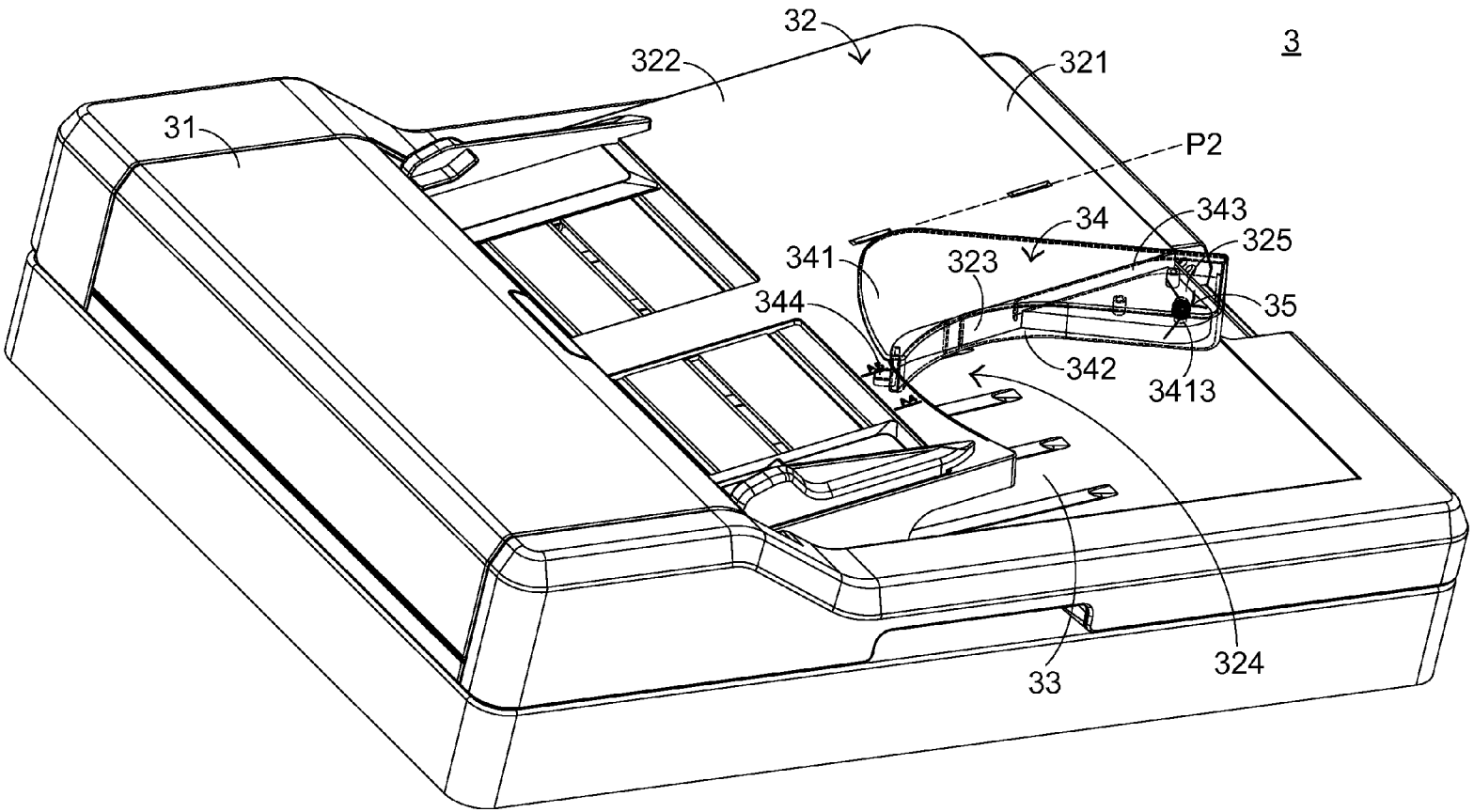
FIG. 8 is a schematic perspective view illustrating the situation of pushing the pushing member of the automatic document feeder according to the embodiment of the present invention.
Figure 9:
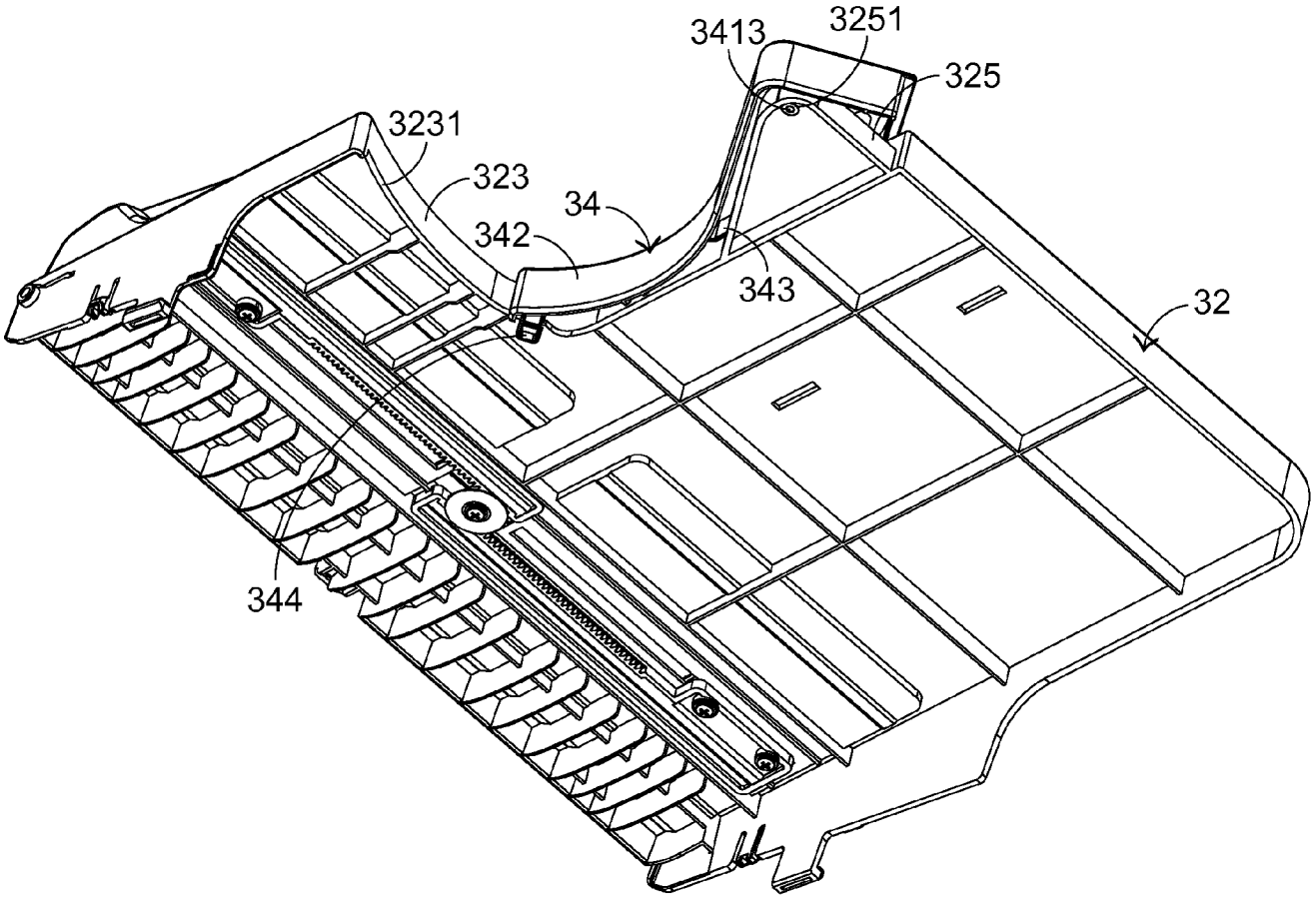
FIG. 9 is a schematic perspective view illustrating the situation of pushing the pushing member of the automatic document feeder of FIG. 8 and taken along another viewpoint.

Hereinafter, a way of removing the document from the document discharge tray 33 will be illustrated with reference to FIGS. 8 and 9. FIG. 8 is a schematic perspective view illustrating the situation of pushing the pushing member of the automatic document feeder according to the embodiment of the present invention. FIG. 9 is a schematic perspective view illustrating the situation of pushing the pushing member of the automatic document feeder of FIG. 8 and taken along another viewpoint. After the paper sheet is transported to the document discharge tray 33 through the casing 31 by the automatic document feeder, the paper sheet may be removed from the document discharge tray 33. For removing the paper sheet from the document discharge tray 33, the user's palm may be firstly moved to a position near the pushing member 34, which is disposed over the document discharge tray 33. Then, the user's palm is contacted with an outer surface of the contacting plate 342 of the pushing member 34. Since the elastic force provided by the elastic element 35 is much lower than the pushing force provided by the user's palm, the contacting plate 342 is correspondingly pushed and moved in response to the pushing force. At the same time, the elastic element 35 is compressed in response to the pushing force. As the contacting plate 342 is pushed, the base plate 341 is correspondingly swung relative to the document input tray 32 along the trajectory parallel with the top surface 322 of the document input tray 32. Consequently, the base plate 341 is swung from the first position P1 to a position over the top surface 322 of the document input tray 32, and the fixing structure 344 is moved along the lower edge 3231 of the extension plate 323.

As the base plate 341 is swung along the trajectory parallel with the top surface 322 of the document input tray 32 from the first position P1 to a second position P2, the stopping structure 343 of the pushing member 34 is contacted with the extension plate 323 of the document input tray 32, so that the base plate 341 is no longer swung. Under this circumstance, the paper sheets on the document discharge tray 33 are exposed through the notch 324 of the document input tray 32. Then, the user's palm may be continuously moved to the document discharge tray 33 to remove the paper sheet.

When the user's palm is departed from the pushing member 34, the pushing force exerted on the contacting plate 342 is eliminated. Consequently, the elastic force provided by the elastic element 35 is exerted on the contacting plate 342. In response to the elastic force, the base plate 341 is correspondingly moved. That is, the base plate 341 is swung along the trajectory parallel with the top surface 322 of the document input tray 32 again to be departed from the second position P2. At the same time, the stopping structure 343 is detached from the extension plate 323, and is no longer contacted with the extension plate 323. In addition, the fixing structure 344 is moved along the lower edge 3231 of the extension plate 323 until the base plate 341 is swung to the first position P1. Meanwhile, the pushing member 34 is returned to the original position.

In this embodiment, the first connecting part 3413 is a protrusion structure, and the second connecting part 3251 is a perforation. It is noted that numerous modifications and alterations of the first connecting part 3413 and the second connecting part 3251 may be made while retaining the teachings of the invention. In a second embodiment, the first connecting part is a perforation, and the second connecting part is a protrusion structure. In a third embodiment, the first connecting part is a protrusion structure, the elastic element is sheathed around the first connecting part, and the second connecting part is a sleeve for accommodating the protrusion structure. In a fourth embodiment, the first connecting part is a protrusion structure, the second connecting part is a sleeve, and the elastic element is sheathed around the second connecting part. In a fifth embodiment, the first connecting part is a sleeve, the elastic element is sheathed around the first connecting part, and the second connecting part is a protrusion structure. In a sixth embodiment, the first connecting part is a sleeve, the second connecting part is a protrusion structure, and the elastic element is sheathed around the second connecting part.

From the above descriptions, the present invention provides an automatic document feeder. In the automatic document feeder, a pushing member is disposed on a document input tray. By pushing the pushing member, the pushing member may be swung relative to the document input tray to expose a notch of the document input tray. Consequently, a document discharge tray disposed under the document input tray is exposed for facilitating the user to remove the paper sheet from the document discharge tray. When the pushing member is no longer pushed by the user, an elastic element contacted with the pushing member provides an elastic force to push the pushing member, so that the pushing member is returned to the original position. When compared with the conventional automatic document feeder, the use of the automatic document feeder of the present invention can simplify the actions of the user's hand. In other words, the documents can be easily removed from the document discharge tray by using the automatic document feeder of the present invention.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding a paper sheet to a scanning region of a scanning module or a printing region of a printing module, said automatic document feeder comprising:

a casing;

a document input tray connected with said casing for placing said paper sheet thereon;

a document discharge tray disposed on said casing and located under said document input tray, wherein after said paper sheet is transferred through said scanning region or said printing region, said paper sheet is placed on said document discharge tray;

a pushing member disposed on said document input tray and located at an end of said document input tray, wherein by pushing said pushing member to allow said pushing member to be swung relative to said document input tray along a trajectory parallel with a top surface of said document input tray, said paper sheet on said document discharge tray is exposed through said document input tray; and an elastic element having two terminals respectively contacted with said document input tray and said pushing member for providing an elastic force to said pushing member, wherein when said pushing member is not pushed, said pushing member is returned to an original position in response to said elastic force.

2. The automatic document feeder according to claim 1, wherein said pushing member comprises:

a base plate;

a contacting plate extended from said base plate and perpendicular to said base plate, wherein as said contacting plate is pushed, said base plate is correspondingly swung relative to said document input tray along said trajectory parallel with said top surface of said document input tray;

a stopping structure extended from said contacting plate and perpendicular to said base plate, wherein when said document input tray is contacted with said stopping structure, said base plate fails to be swung; and a fixing structure extended from said contacting plate and engaged with a lower edge of said document input tray.

3. The automatic document feeder according to claim 2, wherein a top surface of said base plate is parallel with said top surface of said document input tray, and an altitude of said top surface of said base plate is higher than an altitude of said top surface of said document input tray, wherein as said contacting plate is pushed and said base plate is swung relative to said document input tray along said trajectory parallel with said top surface of said document input tray, said base plate is swung to a position over said top surface of said document input tray, and said fixing structure is moved along said lower edge of said document input tray.

4. The automatic document feeder according to claim 2, wherein said base plate comprises a first connecting part, which is extended from said base plate and perpendicular to said base plate, wherein said first connecting part is connected with said document input tray, and said elastic element is sheathed around said first connecting part and fixed on said first connecting part, wherein as said contacting plate is pushed and said base plate is swung relative to said document input tray, said elastic element is compressed by said contacting plate and said base plate is swung from a first position along said trajectory parallel with said top surface of said document input tray, wherein when said base plate is swung to a second position, said stopping structure is contacted with said document input tray, so that said base plate is no longer swung, wherein when said contacting plate is not pushed, said base plate is swung from said second position and returned to said first position in response to said elastic force provided by said elastic element.

5. The automatic document feeder according to claim 4, wherein said document input tray comprises a second connecting part, wherein after said second connecting part is connected with said first connecting part, said first connecting part and said second connecting part are combined together.

6. The automatic document feeder according to claim 5, wherein said first connecting part is a protrusion structure, and said second connecting part is a perforation.

7. The automatic document feeder according to claim 5, wherein said second connecting part is extended from said document input tray and perpendicular to said top surface of said document input tray, wherein said first connecting part is a sleeve, and said second connecting part is a protrusion structure.

8. The automatic document feeder according to claim 5, wherein said second connecting part is extended from said document input tray and perpendicular to said top surface of said document input tray, wherein said first connecting part is a protrusion structure, and said second connecting part is a sleeve.

9. The automatic document feeder according to claim 1, wherein said document input tray comprises:

an extension plate extended from said document input tray;

a notch located at said end of said document input tray; and a connecting plate extended from a position of said extension plate near said end of said document input tray and extended toward said notch, wherein said connecting plate is disposed under said pushing member, and said pushing member is fixed on said connecting plate, wherein as said pushing member is pushed, said pushing member is swung from said notch along said trajectory parallel with said top surface of said document input tray.

10. The automatic document feeder according to claim 9, wherein said connecting plate comprises a second connecting part, which is extended from said connecting plate and perpendicular to said connecting plate, wherein said second connecting part is connected with said pushing member, so that said pushing member is disposed on said document input tray, wherein said elastic element is sheathed around said second connecting part, wherein as said pushing member is pushed and said pushing member is swung relative to said connecting plate of said document input tray, said elastic element is compressed by said pushing member and said pushing member is swung from a first position to a second position along said trajectory parallel with said top surface of said document input tray, wherein when said pushing member is not pushed, said pushing member is swung from said second position and returned to said first position in response to said elastic force provided by said elastic element.

11. The automatic document feeder according to claim 10, wherein said pushing member comprises a first connecting part, wherein after said second connecting part is connected with said first connecting part, said first connecting part and said second connecting part are combined together.

12. The automatic document feeder according to claim 11, wherein said first connecting part is a perforation, and said second connecting part is a protrusion structure.

13. The automatic document feeder according to claim 11, wherein said first connecting part is extended from said pushing member and perpendicular to said top surface of said pushing member, wherein said first connecting part is a sleeve, and said second connecting part is a protrusion structure.

14. The automatic document feeder according to claim 11, wherein said first connecting part is extended from said pushing member and perpendicular to a top surface of said pushing member, wherein said first connecting part is a protrusion structure, and said second connecting part is a sleeve.

* * * * *